United States Patent [19]

Fukuda

[11] 4,267,787

[45] May 19, 1981

[54] CONTROL METHOD FOR A TUFTING MACHINE

[76] Inventor: Tsutomu Fukuda, 785-1 Kunikane, Kamisocho, Kakogawashi, Japan

[21] Appl. No.: 140,833

[22] Filed: Apr. 16, 1980

[30] Foreign Application Priority Data

Jun. 29, 1979 [JP] Japan ..... 54-81341

[51] Int. Cl.[3] ..... D05C 15/20

[52] U.S. Cl. ..... 112/266.2; 112/79 R; 112/272; 112/277

[58] Field of Search ..... 112/266.2, 79 R, 79 A, 112/272, 277, 266.1, 262.1

[56] References Cited

U.S. PATENT DOCUMENTS

| | | | |
|---|---|---|---|
| 3,459,143 | 8/1969 | Ellison et al. | 112/266.2 |
| 3,550,543 | 12/1970 | Crawford | 112/266.2 |
| 4,123,985 | 11/1978 | Fentress | 112/266.2 |
| 4,166,423 | 9/1979 | Brienza et al. | 112/278 |

*Primary Examiner*—H. Hampton Hunter
*Attorney, Agent, or Firm*—Oblon, Fisher, Spivak, McClelland & Maier

[57] ABSTRACT

A method of controlling a tufting machine including preestablishing a selected stitch number and a selected yarn feed length for a predetermined unit feed length of ground fabric, determining stitch number and yarn feed length for the unit feed length of ground fabric by means of measured values respectively obtained from a ground fabric feed detector, a yarn feed detector and a stitch number detector, comparing the measured values with the preestablished stitch number and the preestablished yarn feed length, and automatically controlling the rotation speeds of a spiked roller and a yarn roller respectively to correct the ground fabric feed and the yarn feed to the preestablished values whenever the measured values depart from a predetermined tolerance from the selected values.

1 Claim, 3 Drawing Figures

CONTROL METHOD FOR A TUFTING MACHINE

BACKGROUND OF THE INVENTION

1. Field of the Invention

This invention is concerned with a control method for a tufting machine used to weave carpets.

2. Description of the Prior Art

Generally in the control of a conventional tufting machine, the number of stitches in a unit length of woven carpet is visually counted, the length of yarn to be fed is calculated from the weighted amount of yarn being used, and it is judged if the woven carpet is made to the required color pattern. These factors have then been controlled as necessary by changing a spiked roller or a yarn roller in the conventional tufting machine. However, such operations have led to very complicated control of the tufting machine, which are accompanied by the disadvantage of inability of making fine adjustment to cope with the requirements of color pattern, and the requirement of having higher highly skilled and experienced personnel for the operation of the machine.

SUMMARY OF THE INVENTION

Accordingly, one object of this invention is to provide a novel method for controlling a tufting machine, which corrects the stated disadvantages of conventional methods for controlling such machines.

The object of the invention is achieved by providing a quite practical and convenient control method for tufting machines characterized by measuring the number of stitches and feeding yarn length for a unit feed length of the ground fabric, and automatically controlling the feeding of ground fabric and/or yarn. The method results in uniform and continuous finishing of a carpet to a required color pattern merely by selected setting of standard values depending on the color pattern of the carpet to be woven, and allows fine control without requiring highly skilled personnel.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
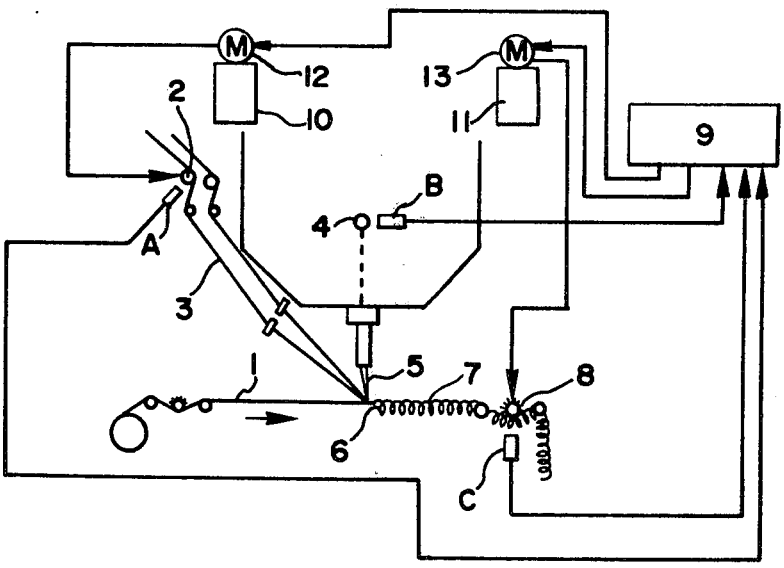
FIG. 1 is a schematic drawing indicating the principle of the control method of a tufting machine related to an exemplary embodiment of this invention.

Referring now to the drawings, wherein like reference numerals designate identical or corresponding parts throughout the several views, and more particularly to FIG. 1 thereof, the numeral 1 refers to a ground fabric, the numeral 3 refers to yarn fed by a yarn roller 2 and driven into the ground fabric 1 by means of a needle 5. The needle 5 is driven by stitch shaft 4 to form pile 6. The yarn 3 is stitched to a tufted fabric of carpet 7 and is devised to be sent out by a spiked roller 8.

Letter A is a yarn feed detector which detects the speed of yarn being fed by way of a photoelectric contactless switch, and generates a definite number of pulses for a certain length of yarn feeding.

Letter B designates a stitch number detector which detects the number of the strokes of needle 5 corresponding to stitch number by way of magnetic contactless switch, and generates a definite number of pulses for a stroke of the needle 5.

Letter C designates a ground fabric feed detector, which detects the speed of ground fabric feeding and generates a definite number of pulses for a certain length of ground fabric feeding. Now, numeral 9 designates a control device, which receives pulses issued from yarn feed detector A, stitch number detector B and ground fabric feed detector C respectively; and determines the number of stitches and yarn feed length corresponding to a unit ground fabric feed; then compares this value with a preestablished standard value, and generates an output signal when the value deviates outside an allowable limit, changing the ratio of PIV 10 and 11, causing pilot motors 12 and 13 to increase or decrease the rotation of yarn roller 2 and spiked roller 8 to control and correct the tufting machine.

Figure 2:
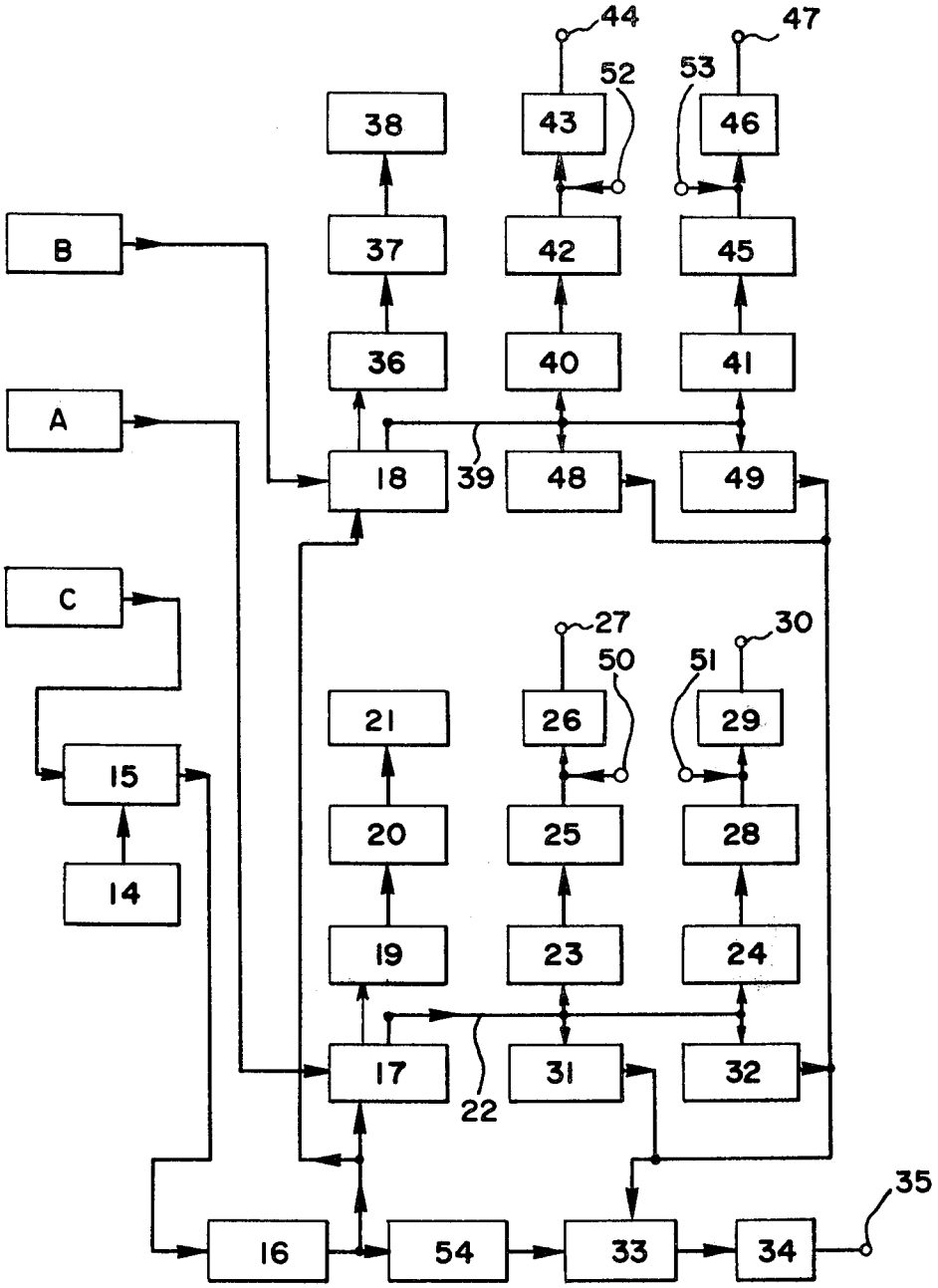
FIG. 2 is a block diagram showing the control circuit of the control panel.

FIG. 2 is a block diagram indicating the control circuit of above described control device 9, of which the structure and function are now described.

In FIG. 2, letter A designates the yarn feed detector, letter B designates the stitch number detector and letter C designates the ground fabric feed detector. Numeral 14 designates a standard value setting device, which is set to the predetermined standard stitch number and standard yarn feed length for a unit ground fabric feed length corresponding to the color pattern of the carpet to be tufted by way of a digital switch, and the set signal of the standard value is applied to a synchronous counter 15. The synchronous counter 15 receives and counts the number of pulses issued from the ground fabric feed detector C, synchronizing with the rotation of the skid roller 8, and is arranged to give a standard set-signal as derived from the standard value setting device 14 to counters 17 and 18, via gate 16 which opens a gate when the synchronous counter 15 completely counts the number of pulses corresponding to the unit ground fabric feed length set by standard value setting device 14.

The counter 17 counts the pulse number corresponding to the unit ground fabric feed length counted by synchronous counter 15, and the pulses issued from yarn feed detector A during the time between successive gate pulses, and thereby measures the yarn feed length corresponding to the unit ground fabric feed length. The obtained pulse number is latched by a latch relay 19, and converted to the length of pile 6 by decoder 20, with the pile length expressed digitally by a scale factor on a ratio indicator 21. The counter 17 is devised to compare the measured value of yarn feed length for a unit ground fabric feed length with its standard value, and determine their difference as plus or minus percentage error, and to issue an error signal 22 corresponding to the error value.

Numeral 23 designates an upper control limit setting apparatus and numeral 23 designates a lower control limit setting apparatus, which are respectively set to plus or minus allowable percentage discrepancy value ranges of the difference of yarn feed length from the standard yarn feed value for unit ground fabric feed length. When the error signal 22 exceeds the plus side allowable value, upper limit control 23 functions to initiate the issuance of a signal from command signal generator 25 which causes the issuance of a speed reducing command signal 27 through the relay 26. Conversely, when the error signal exceeds the minus allowable limit, lower limit control 24 operates to initiate issuance of a corresponding signal from command signal generator 28 which causes the issurance of a speed increasing command signal 30 through relay 29. Then the above described speed reducing command signal 27 or speed increasing command signal 30 is sent to the pilot motor 12, and changes the ratio of PIV (stepless transmission) 10 and increases or decreases the rotation speed of yarn roller 2 resulting in the automatic control and correction of the rotation speed of the yarn roller until the error signal 22 returns to the allowable range of plus and minus deviation.

Numeral 31 designates an upper stop limit setting apparatus and numeral 32 designates a lower stop setting apparatus respectively, and are devised to issue a signal when error signal 22 largely exceeds the plus or minus allowable range to actuate stop signal generator 33 which causes issuance of a stop signal 35 through a relay 34 to open the main switch of the tufting machine and prevent the occurrence of failure of the tufting machine.

Counter 18 counts the pulse number corresponding to the unit ground fabric feed length counted by the synchronous counter 15 and the pulses issued from the stitch number detector B during the period between successive gate pulses, and measures the number of stitches for a unit ground fabric feed length. The output of counter 18 corresponding to the number of stitches is latched by a latch relay 36, whose output is coupled to decoder 37 devised to indicate the stitch number digitally for display by a stitch number indicator 38.

The counter 18 compares the measured value of stitch number for a unit ground fabric feed length with the standard number, determines the deviation as a plus or minus percentage error, and issues error signal 39 corresponding to the error value.

Numeral 40 designates a control upper limit setting apparatus and numeral 41 designates a control lower limit setting apparatus which are respectively previously set to the plus or minus percentage allowable value of the deviation of stitch number for unit ground fabric feed length from its standard value. Control upper limit setting apparatus 40 operates whenever the error signal 39 exceeds the plus allowable value to initiate the issuance of a signal from command signal generator 42 and which in turn initiates generation of a speed reducing command signal 44 through relay 43.

Conversely, when the error signal 39 exceeds the minus allowable limit, control lower limit setting apparatus 41 operates to initiate the issuance of a signal from a command signal generator 45, which in turn initiates generation of a speed increasing command signal 47 through a relay 46. The above stated speed reducing command signal 44 or speed increasing command signal 47 is fed to the pilot motor 13 to change the ratio of PIV (stepless transmission) 11, which increases or decreases the rotating speed of the spiked roller 8 to control and automatically correct the rotating speed of the spiked roller 8 until the error signal 39 falls within the plus or minus allowable range.

Numerals 48 and 49 designate an upper stop limit setting apparatus and a lower stop limit setting apparatus respectively, are devised to issue a signal when the error signal 39 largely exceeds the plus or minus allowable value respectively, to to operate stop signal generator 33 to cause generation of a stop command signal 35 through relay 34 to open the main switch of the tufting machine and prevent the occurrence of the failure of tufting machine.

Manual operation switches 50, 51, 52 and 53 are installed between each command signal generator and relay, such as between 25–26, 28–29, 42–43 and 45–46, such that it is possible to increase or decrease rotational speed of yarn roller 2 and spiked roller 8 optionally, by independently issuing speed reducing command signal 27 and 44 or speed increasing command signal 30 and 47 separately without any relation to automatic control corrections.

Numeral 54 designates a production quantity preset counter, which is set with a ground fabric length corresponding to a predetermined production quantity by way of a digital switch. Counter 54 counts the number of gate pulses received, and indicates the number of gate pulses and ground fabric length determined from the unit ground fabric feed length digitally, to issue a signal when the measured ground fabric length corresponds to the preset production quantity to operate stop signal generator 33, open the main switch of the tufting machine by sending stop signal 35 through relay 34 and preset the production quantity.

Figure 3:
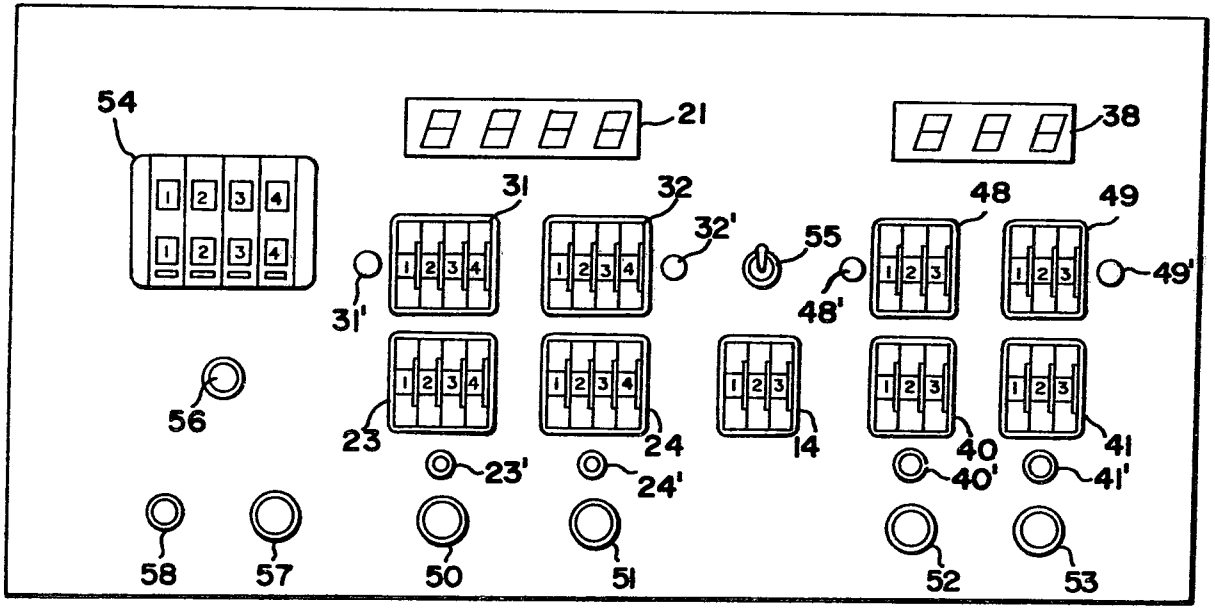
FIG. 3 is a plan view of a control panel for practicing the control method of the invention.

FIG. 3 is a plan view of the control panel, in which numeral 55 designates a manual main switch of the tufting machine. Numeral 56 designates a reset switch to be operated when the standard value is to be changed, numeral 57 designates a starting button and numeral 58 designates a power source input lamp respectively.

Referring to the Figure, numeral 38 designates a stitch number indicator, numeral 21 designates a ratio indicator and numeral 54 designates a production quantity preset counter respectively, corresponding with identical symbols in FIG. 2.

Numeral 23 designates a control upper limit setting apparatus, numeral 24 designates a control lower limit setting apparatus, numeral 31 designates a lower stop limit setting apparatus respectively.

Further, numeral 40 designates a control upper limit setting apparatus, numeral 41 designates a control lower limit setting apparatus, numeral 48 designates an upper stop limit setting apparatus, numeral 49 designates a lower stop limit setting apparatus and numeral 14 designates a standard value setting device respectively. The above stated apparata on the control panel with numerals 38, 21, 54, 23, 24, 31, 32, 40, 41, 48, 49 and 14 are made to be visually observed by digital indication.

In the drawing, numerals 23', 24', 31', 32', 40', 41', 48' and 49' respectively are alarm lamps attached to 23, 24, 31, 32, 40, 41, 48 and 49 respectively devised to light on and indicate what error value was occurred and what kind of control operation or stop control is being performed when the error value corresponds to error signal 22 or 39 has exceeded the permissible value.

In the drawing, numerals 50 and 51 designate manual switches to decrease or increase yarn roller speed and numerals 52 and 53 designate manual switches to decrease or increase spiked roller speed respectively.

The operation of the above control panel is described as follows:

Firstly, the manual main switch 55 of the tufting machine is turned on and the standard stitch number and the standard yarn feed length are preset by means of the standard value setting device, depending on the color patterns to be woven.

Secondly, the control upper limit setting apparata 23 and 40, control lower limit setting apparata 24 and 41, upper stop limit setting apparata 31 and 48 and lower stop limit setting apparata 32 and 49 are respectively set.

Further, the planned production quantity is set on the production quantity preset counter 54, and the starting button 57 is pushed "on", so that the tufting machine starts operation. Thereafter, the production quantity is continuously indicated on the production quantity preset counter, and the tufting machine stops when the preset production quantity is attained. During this period, if and when the measured value of the stitch number and standard yarn feed length for a unit ground fabric feed length departs from the standard value, either of alarm lamp 23', 40' or 24', 41' corresponding to control upper limit setting apparatus 23, 40 or control lower limit setting apparatus 24, 41 are lighted to indicate the status, and automatically control and correct the rotation speed of yarn roller 2 or spiked roller 8.

If the above measured value largely departs from the standard value, either of the alarm lamps 31', 48' or 32', 49' correspond to upper stop limit setting apparatus 31, 48 or lower stop limit setting apparatus 32, 49 are lighted to indicate the fact and the tufting machine is made to stop operation. In this case, if the cause of failure is investigated and repaired, the tufting machine can be reoperated by pushing starting button 57 on. Naturally, the rotation speed of yarn roller 2 and spiked roller 8 can be controlled by operation of manual switch 50, 51, 52 and 53 without any relation to the standard value.

Correction or change of the standard value can be performed by pushing reset switch 56 to reset each set value starting from zero.

As explained above in detail, this invention devises to preset a standard stitch number and standard yarn feed length for the unit ground fabric feed length, determine stitch number and yarn feed length for unit ground fabric feed length with each detected value of ground fabric feed detector, yarn feed detector and stitch number detector; compare the measured value with the standard stitch number and standard yarn feed length; and automatically control and correct the rotating speed of the spiked roller and yarn roller; and has great advantage in comparison to the conventional method as follows:

(1) The tufting machine can be controlled quite easily and fully automatically, because the rotation speed of the spiked roller and yarn roller are automatically controlled and corrected, if the measured value departs from the standard value.

(2) Because control and correction of a tufting machine is performed automatically, the tufting machine is not required to be watched as in the case of conventional machine, and there is no fear of personnel inattention or fault, which results in a great saving of manpower.

(3) Because the only required operation is to preset the standard stitch number and the standard yarn feed length for a unit ground fabric feed length, operation is quite simple requiring no skill, can be handled by unskilled personnel easily, and a uniform finish of products can be expected.

(4) Because the rotation speeds of the spiked roller and yarn roller are controlled and corrected independently or parallelly, good response of correction control is obtained, and the correction control is finished in a short time.

(5) Because control and correction can be performed without stopping the tufting machine, long hours of continuous operation can be performed which leads to a great increase of production capacity.

(6) Because the accuracy of correction can be set freely by changing the range of allowable limit, fine controls in accordance with color design is possible.

The method of this invention is far more functional compared with the conventional method, and provides a quite practical and convenient control method for a tufting machine.

Although an embodiment was explained for the example of applying this invention for the control of one tufting machine, it is evident that the invention can be embodied for the control of many tufting machines parallelly or independently, for example by collective control by way of employing a mini-computer.

Obviously, numerous modifications and variations of the present invention are possible in light of the above teachings. It is therefore to be understood that within the scope of the appended claim, the invention may be practiced otherwise than as specifically described herein.

What is claimed as new and desired to be secured by Letters Patent of the United States is:

1. A method of controlling a tufting machine comprising:

preestablishing a selected stitch number and a selected yarn feed length for a predetermined unit feed length of ground fabric;

determining stitch number and yarn feed length for the unit feed length of ground fabric by means of measured values respectively obtained from a ground fabric feed detector, a yarn feed detector and a stitch number detector;

comparing the measured values with the preestablished stitch number and the preestablished yarn feed length; and automatically controlling the rotation speeds of a spiked roller or a yarn roller respectively to correct the ground fabric feed and the yarn feed to the preestablished values whenever the measured values depart from a predetermined tolerance from the selected values.

* * * * *